US006067836A

United States Patent [19]

Kaya et al.

[11] Patent Number: 6,067,836

[45] Date of Patent: May 30, 2000

[54] METHOD AND SYSTEM FOR SUPPRESSING FORMATION OF SCALE DEFECTS DURING HOT FINISH ROLLING

[75] Inventors: Akira Kaya; Keiji Mizuta; Junsou Fukumori, all of Hiroshima; Kyung-Zoon Min; Jae-Young Lee, both of Tokyo; Young-Gil Seo; Jung-Do Park, both of Kwangyang, all of Japan

[73] Assignee: Mitsubishi Heavy Industries, Ltd., Tokyo, Japan

[21] Appl. No.: 09/201,858

[22] Filed: Dec. 1, 1998

[30] Foreign Application Priority Data

Dec. 5, 1997 [JP] Japan ..... 9-335233

[51] Int. Cl.[7] ..... B21B 27/06

[52] U.S. Cl. ..... 72/201; 72/202

[58] Field of Search ..... 72/39, 40, 200, 72/201, 202, 364, 8.5, 11.3, 12.2

[56] References Cited

U.S. PATENT DOCUMENTS 3,889,507 6/1975 Kranenberg et al. ..... 72/201
5,133,205 7/1992 Rostik et al. ..... 72/202
5,694,799 12/1997 Wolpert et al. ..... 72/201

FOREIGN PATENT DOCUMENTS 57-154301 9/1982 Japan .
1-205810 8/1989 Japan .
2-59108 2/1990 Japan .
9006821 6/1990 WIPO .

OTHER PUBLICATIONS

Japanese Patent Abstract, 09066303, Sumitomo Metal Industries, Ltd., Mar. 11, 1997.
Japanese Patent Abstract, 08276212, Nippon Steel Corp., Oct. 22, 1996.

*Primary Examiner*—Rodney Butler

[57] ABSTRACT

A plurality of finishing mills for finish rolling a rolled material are arranged in a row to construct a finishing mill group, 1st to 3rd surface coolers for cooling the surfaces of the rolled material are provided on the entrance side of the 1st to 3rd finishing mills of the fishing mill group, and the range of cooling of the rolled material by the surface coolers are set to be a range of 0.3 to 1.5 m toward the upstream side from a position separated by 1.5 m or less from the center of the work rolls of each of the finishing mills toward the entrance side of each of the finishing mills.

6 Claims, 5 Drawing Sheets

METHOD AND SYSTEM FOR SUPPRESSING FORMATION OF SCALE DEFECTS DURING HOT FINISH ROLLING

BACKGROUND OF THE INVENTION

1. Field of the Invention

The present invention relates to a method and a system for suppressing the formation of scale defects during hot finish rolling by minimizing scale formation during rolling of a strip material.

2. Description of Related Art

When iron contacts a gas, such as oxygen or air, at a high temperature during rolling of a strip material, a film of the reaction product, i.e., scale, is formed on the surfaces of the strip material. Due to the formation of scale, the strip material may become susceptible to adverse influences, such as oxidation. Therefore, the scale should be removed. The customary practice for removing scale formed on a strip material has been to jet pressurized water at the surface of the strip material.

FIG. 4 is a schematic view of a scale removing device of a conventional hot finish rolling mill system. FIG. 5 is a graph showing the temperature of a rolled material and the thickness of scale during finish rolling by a conventional hot finish rolling mill system.

With a conventional hot finish rolling mill system, as shown in FIG. 4, a plurality of finishing mills, i.e., 1st to 7th finishing mills 101, 102, 103, 104, 105, 106 and 107, are provided in a row along the direction of transport of a rolled material S, downstream of a roughing mill (not shown) in the direction of transport. The finishing mills 101, 102, 103, 104, 105, 106 and 107 have a pair of (i.e., upper and lower) work rolls 201, 202, 203, 204, 205, 206 and 207, respectively. A finishing mill group 100 is constructed in this manner. On the entrance side of this finishing mill group 100, a scale breaker 301 is provided for removing scale formed on the rolled material S. The scale breaker 301 has jet nozzles 302 positioned above and below the rolled material S. These jet nozzles 302 direct jets of water at a high pressure of, e.g., 200 kgf/cm$^2$, at the upper and lower surfaces of the rolled material S to remove the scale.

Thus, the rolled material S transported after rough rolling from a slab by a roughing mill is conveyed to the entrance side of the finishing mill group 100, where scale formed on the surface of the rolled material S is removed by the scale breaker 301 before finish rolling. In detail, water that is pressurized at, e.g., 200 kgf/cm$^2$, is jetted through the upper and lower jet nozzles 302 at the upper and lower surfaces of the conveyed rolled material S to remove the adhering scale. The descaled rolled material S is carried to the finishing mill group 100 for rolling by the work rolls 201, 202, 203, 204, 205, 206 and 207 of the 1st to 7th finishing mills 101, 102, 103, 104, 105, 106 and 107, whereby it is sequentially finish rolled to predetermined thicknesses.

FIG. 5 is a graph showing the temperature of the rolled material S and the thickness of its scale during descaling and finish rolling of this material. In this graph, A represents the period of scale removal by the scale breaker 301, and B, C, D, E, F, G and H represent the times of finish rolling by the 1st to 7th finishing mills 101, 102, 103, 104, 105, 106 and 107, respectively. This graph shows that the surface temperature of the rolled material S falls rapidly during the scale removal period A, and also drops at the finish rolling times B, C, D, E, F, G and H. At the same time, the scale is removed or thinned.

With such a hot finishing mill system, the rolled material S should be transported at a high speed in order to raise the work efficiency. When the rolled material S is transported at a high speed, however, its front end collides with the outer peripheral surface of the work roll 201, 202, 203, 204, 205, 206 or 207 when its front end portion is engaged into the finishing mills 101, 102, 103, 104, 105, 106, 107. As a result, the work roll 201, 202, 203, 204, 205, 206 or 207 maybe deformedor damaged. With the hot finishing mill system, therefore, the rolled material S has to be carried at a low speed, with the result that the rolled material S takes a long time until its engagement into the work rolls 201, 202, 203, 204, 205, 206, 207, promoting the formation of scale. Consequently, the thickness of the scale on the rolled material S after rolling exceeds a limit of 5 $\mu$m. During finish rolling, this scale is imprinted into the surface of the rolled material S, causing defects. This deteriorates the quality of the rolled material S markedly.

SUMMARY OF THE INVENTION

The present invention aims to solve these and other problems inherent in the conventional systems. Therefore, one object of the present invention is to provide a method and a system for suppressing the formation of scale defects during hot finish rolling. This and other objects may be accomplished by reliably minimizing the formation of scale on a rolled material, thereby improving the quality of the resulting product.

According to a first aspect of the present invention, there is provided a method for suppressing the formation of scale defects during hot finish rolling of a strip material by finishing mills provided in a row. This method includes cooling an upper surface and a lower surface of the strip material in a range of 0.3 to 1.5 m toward an upstream side from a position separated by 1.5 m or less from the center of work rolls of each of the finishing mills toward an entrance side of each of the first predetermined number of finishing mills during the finish rolling of the strip material, repeatedly surface cooling and finish rolling of the strip material sequentially until the last of the predetermined number of finishing mills is reached, thereby suppressing the formation of scale defects in the surfaces of the strip material.

According to a second aspect of the invention, there is provided a method for suppressing the formation of scale defects during hot finish rolling having steps similar to the first aspect of the invention, wherein the last of the predetermined number of finishing mills is the third finishing mill.

According to a third aspect of the invention, there is provided a system for suppressing the formation of scale defects during hot finish rolling. This system includes a finishing mill group composed of a plurality of finishing mills for finish rolling a strip material, the finishing mills being provided in a row; and surface coolers for cooling an upper surface and a lower surface of the strip material, the surface cooler being provided on an entrance side of each of the first predetermined number of finishing mills of the fishing mill group; the range of cooling of the strip material by the surface coolers being set to be a range of 0.3 to 1.5 m toward an upstream side from a position separated by 1.5 m or less from the center of work rolls of each of the finishing mills toward the entrance side of each of the finishing mills.

According to a fourth aspect of the invention, there is provided a system for suppressing the formation of scale defects during hot finish rolling having features similar to the third aspect of the invention, wherein the last of the predetermined number of finishing mills is the third finishing mill, and the first, second and third surface coolers for cooling the upper and lower surfaces of the strip material are provided on the entrance side of the first to third finishing mills, respectively.

DETAILED DESCRIPTION OF THE PREFERRED EMBODIMENT

An embodiment of the present invention will now be described in detail.

Figure 1:
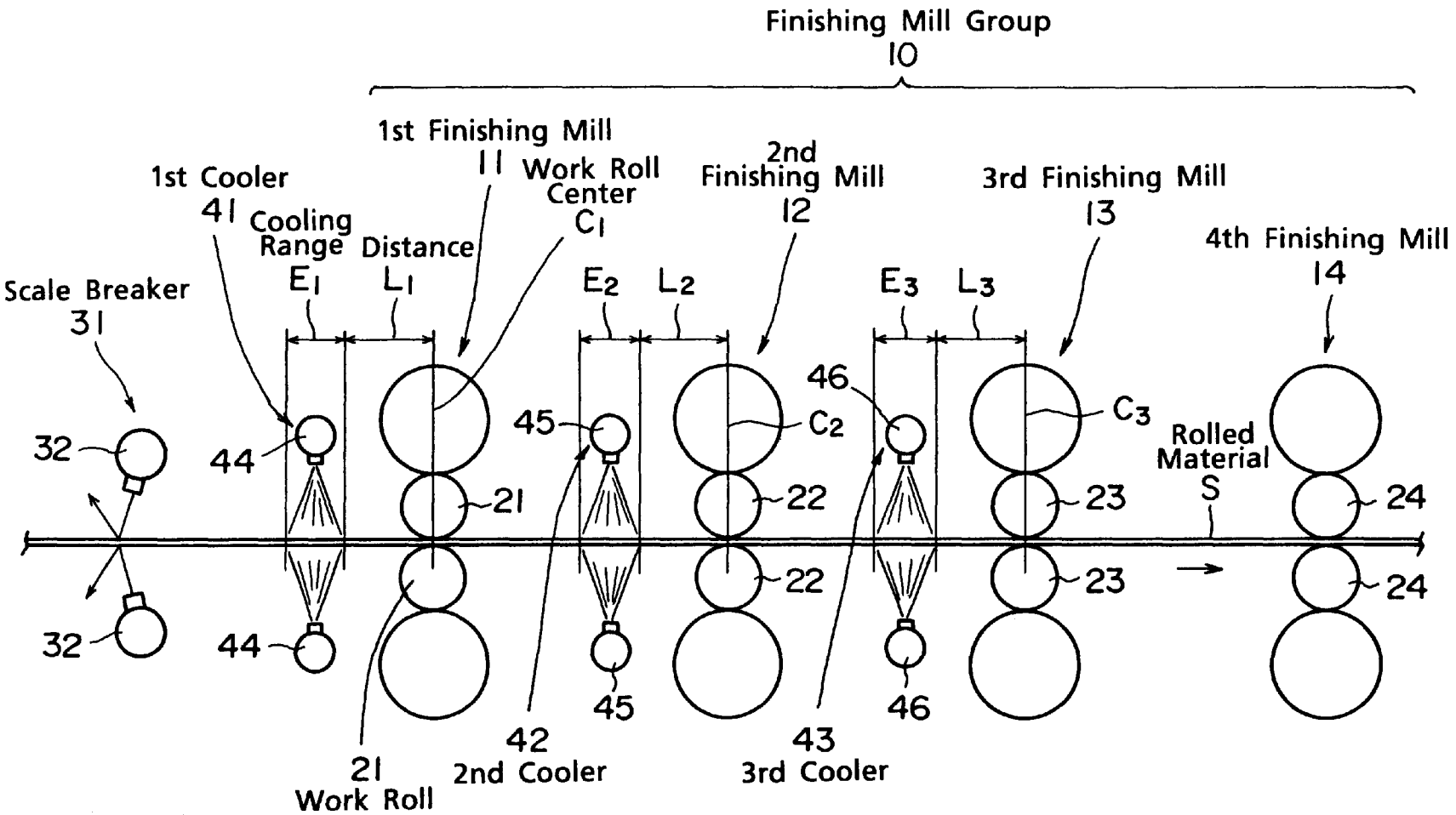
FIG. 1 is a schematic view of a scale defect formation suppressing system for performing a method for suppressing the formation of scale defects during hot finish rolling according to an embodiment of the present invention.
Figure 2:
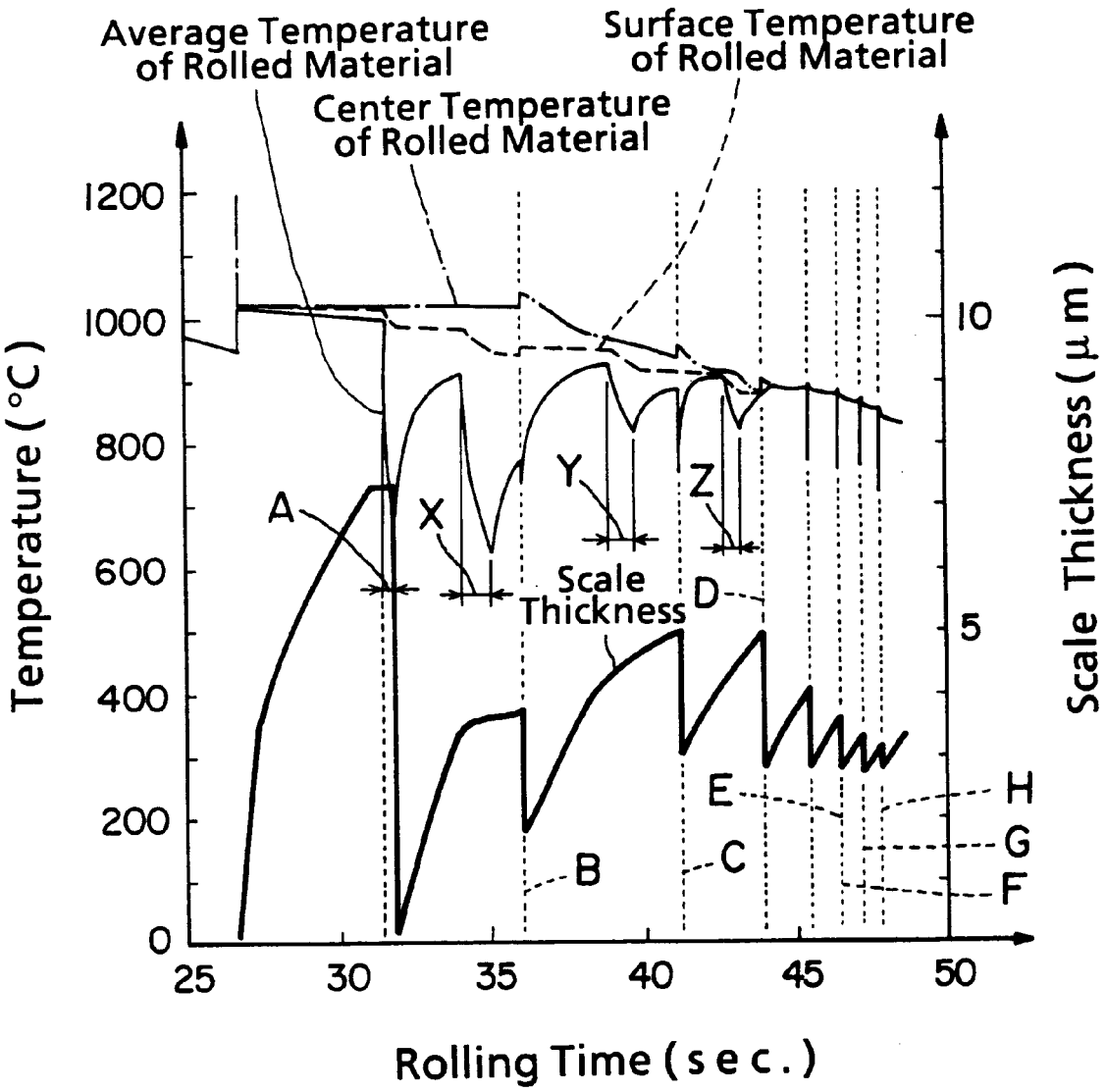
FIG. 2 is a graph showing the temperature of a rolled material and the thickness of scale during finish rolling by a scale defect formation suppressing system during hot finish rolling according to the present embodiment.
Figure 3:
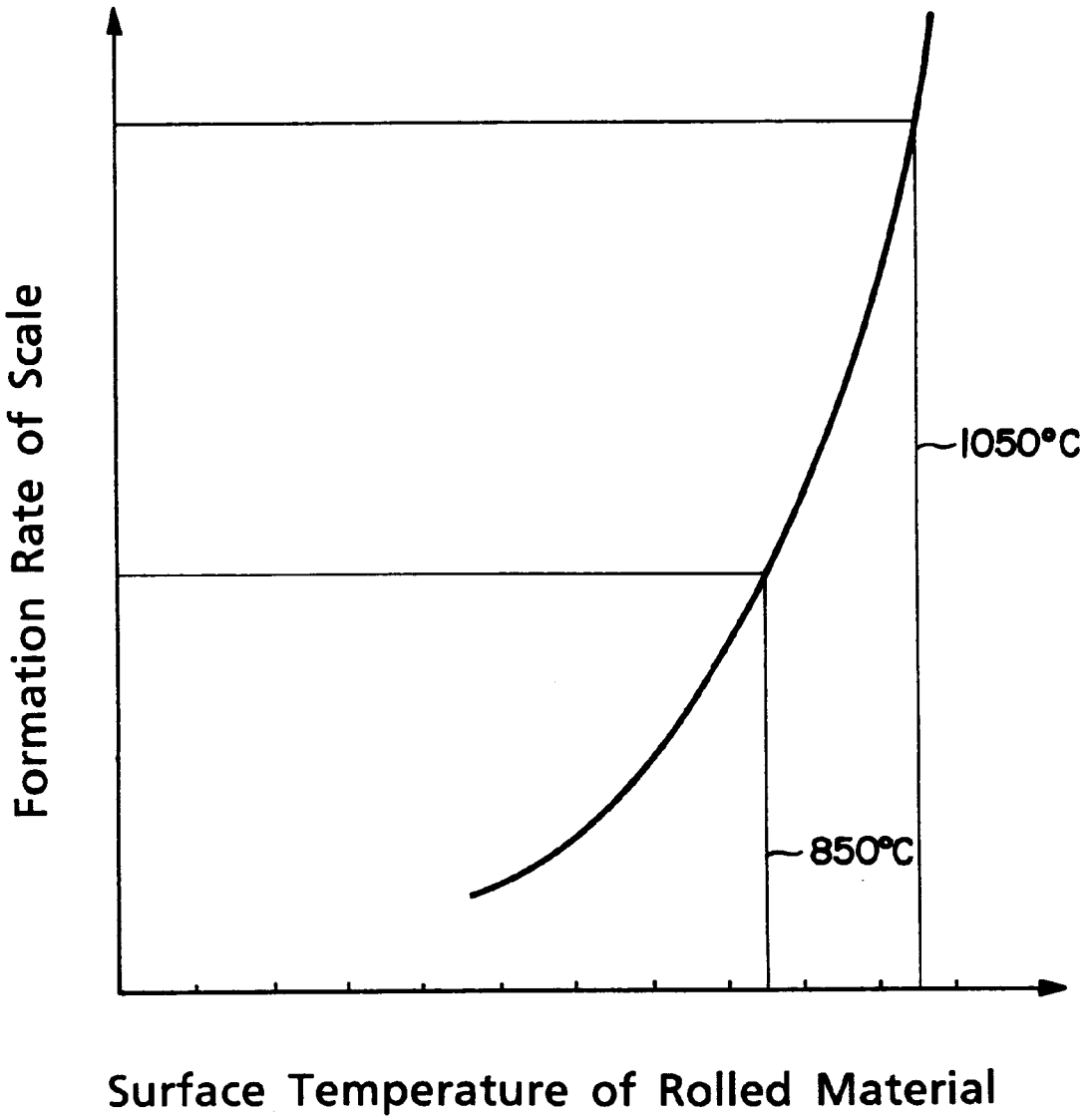
FIG. 3 is a graph showing the formation rate of scale versus the surface temperature of a rolled material by a scale defect formation suppressing system during hot finish rolling according to the present embodiment.
Figure 4:
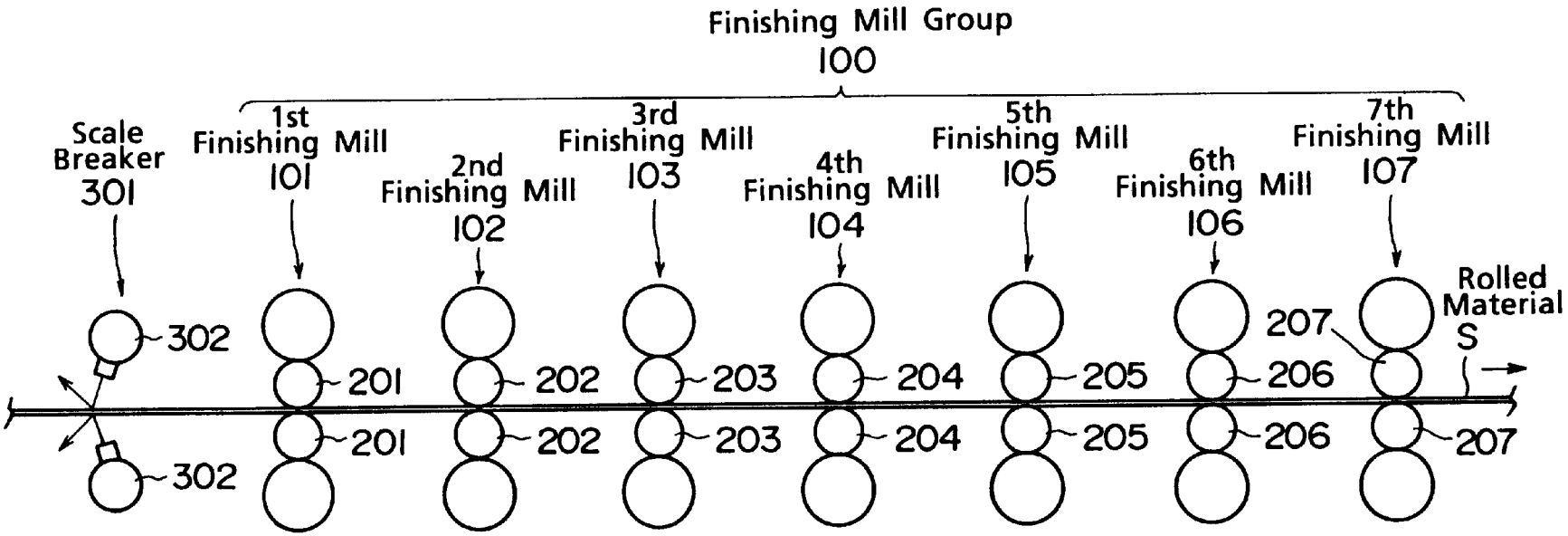
FIG. 4 Prior Art
FIG. 4 is a schematic view of a descaling device of a conventional hot finishing mill system.
Figure 5:
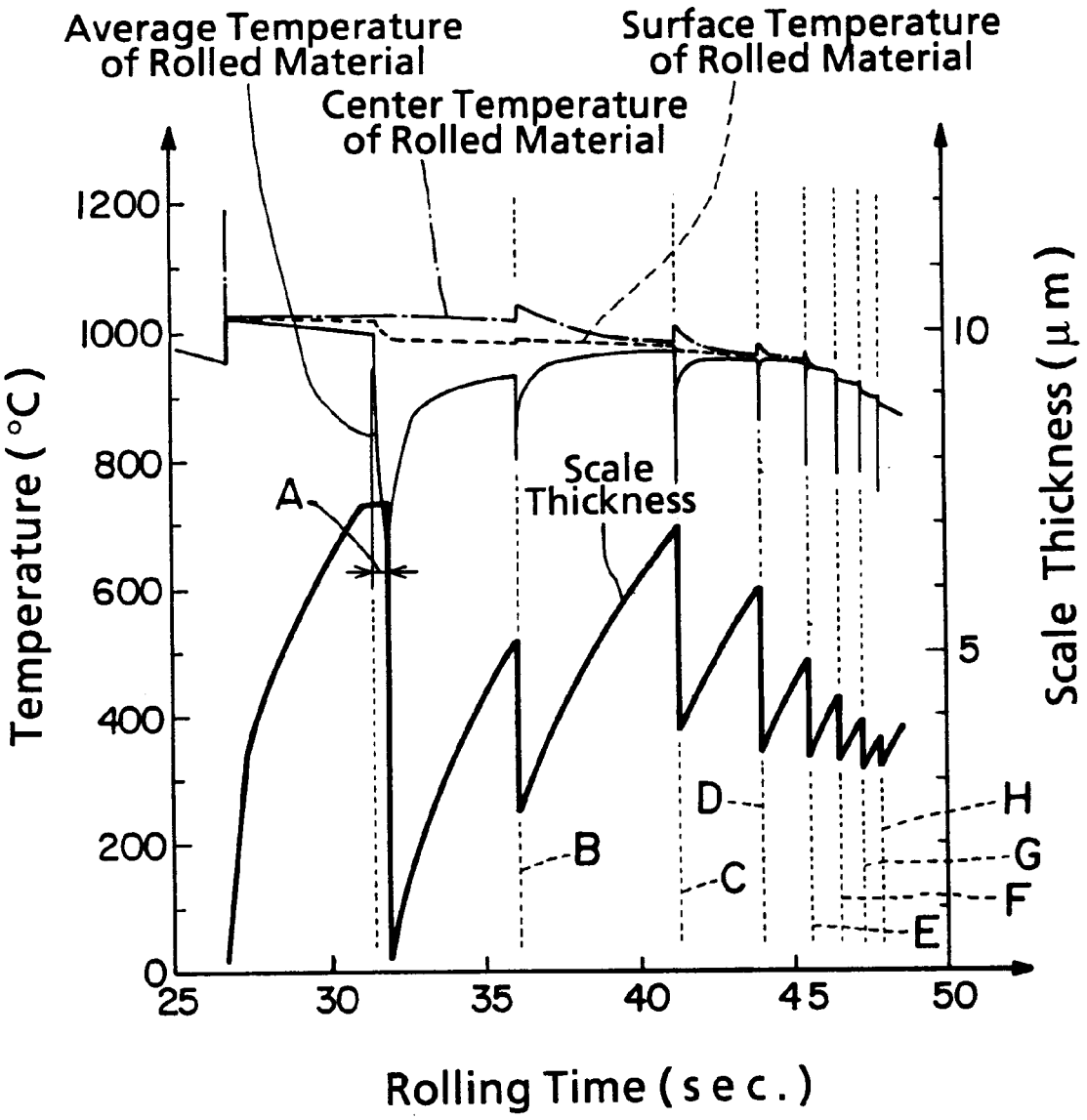
FIG. 5 Prior Art
FIG. 5 is a graph showing the temperature of a rolled material and the thickness of scale during finish rolling by a conventional hot finishing mill system.

FIG. 1 is a schematic view of a scale defect formation suppressing system for performing a method for suppressing the formation of scale defects during hot finish rolling according to an embodiment of the present invention. FIG. 2 is a graph showing the temperature of a rolled material and the thickness of scale during finish rolling by a scale defect formation suppressing system during hot finish rolling according to the present embodiment. FIG. 3 is a graph showing the formation rate of scale versus the surface temperature of a rolled material by a scale defect formation suppressing system during hot finish rolling according to the present embodiment.

With the system for suppressing scale defect formation during hot finish rolling according to the present embodiment, as shown in FIG. 1, a plurality of finishing mills, i.e., a 1st finishing mill 11, a 2nd finishing mill 12, a 3rd finishing mill, a 4th finishing mill, and so on, are provided in a row along the direction of transport of a rolled material S, downstream of a roughing mill (not shown) in the direction of transport. These finishing mills 11, 12, 13, 14 . . . have a pair of (i.e., upper and lower) work rolls 21, 22, 23, 24 . . . , respectively. A finishing mill group 10 is constructed in this manner. On the entrance side of this finishing mill group 10, a scale breaker 31 is provided for removing scale formed on the rolled material S. The scale breaker 31 has a pair of (i.e., upper and lower) jet nozzles 32 above and below the rolled material S. These jet nozzles 32 direct jets of water at a high pressure of, e.g., 180 kgf/cm$^2$, at the upper and lower surfaces of the rolled material S to remove the scale.

On the entrance side of each of the 1st finishing mill 11, the 2nd finishing mill 12 and the 3rd finishing mill 13, a 1st surface cooler 41, a 2nd surface cooler 42, and a 3rd surface cooler 43, respectively, are provided for cooling the upper and lower surfaces of the rolled material S. These 1st, 2nd and 3rd surface coolers 41, 42, 43 have a pair of (i.e., upper and lower) jet nozzles 44, 45, 46, respectively, above and below the rolled material S. These jet nozzles 44, 45, 46 direct jets of cooling water at the upper and lower surfaces of the rolled material S to cool the rolled material S, thereby lowering its surface temperature.

A position at which the jet nozzles 44, 45, 46 of the 1st, 2nd and 3rd surface coolers 41, 42, 43 jet cooling water at the rolled material S is desirably set to be in ranges $E_1$, $E_2$, $E_3$=0.3 to 1.5 m toward an upstream side from a position separated by predetermined distances $L_1$, $L_2$, $L_3$=1.5 m or less from the centers $C_1$, $C_2$, $C_3$ of work rolls 21, 22, 23 of the finishing mills 41, 42, 43 toward an entrance side (leftward in FIG. 1).

Thus, when the rolled material S is to be finish rolled by the hot finishing mill system of the foregoing embodiment, the rolled material S transported after rough rolling from a slab by a roughing mill is conveyed to the entrance side of the finishing mill group 10. There, scale formed on the surfaces of the rolled material S is removed by the scale breaker 31 before finish rolling. In detail, water pressurized at, e.g., 180 kgf/cm$^2$, is jetted through the upper and lower jet nozzles 32 of the scale breaker 31 at the upper and lower surfaces of the conveyed rolled material S to remove the adhering scale. The descaled rolled material S is carried to the finishing mill group 10 for rolling by the work rolls 21, 22, 23, 24 . . . of the 1st finishing mill 11, the 2nd finishing mill 12, the 3rd finishing mill 13, the 4th finishing mill . . . . At this time, the rolled material S is sequentially finish rolled to predetermined thicknesses while being cooled by the surface coolers 41, 42, 43.

That is, cooling water is jetted at the rolled material S in a water volume of, e.g., 7,200 liters/min through the jet nozzles 44 of the 1st surface cooler 41 before rolling is performed by the 1st finishing mill 11, whereby the rolled material S is cooled. The cooled rolled material S is rolled by the work rolls 21 of the 1st finishing mill 11. Then, cooling water in the same water volume is jetted at the rolled material S through the jet nozzles 45 of the 2nd surface cooler 42, whereby the rolled material S is cooled. The cooled rolled material S is rolled by the work rolls 22 of the 2nd finishing mill 12. Further, cooling water in the same water volume is jetted at the rolled material S through the jet nozzles 46 of the 3rd surface cooler 43, whereby the rolled material S is cooled. The cooled rolled material S is rolled-bythework rolls 23 of the 3rd finishing mill 13. Then, the rolled material S is rolled by the work rolls 24 . . . of the 4th finishing mill 14 . . . , whereby it is processed to predetermined thicknesses.

FIG. 2 is a graph showing the temperature of the rolled material S and the thickness of its scale during descaling and finish rolling of this material. In this graph, A represents the period of scale removal by the scale breaker 31, B, C, D, E, F, G and H represent the times of finish rolling by the 1st to 7th finishing mills 11, 12, 13, 14 . . . , respectively, and X, Y and Z represent the periods of cooling by the 1st to 3rd surface coolers 41, 42, 43.

As this graph shows, the surface temperature of the rolled material S drops to 630° C., with most scale being removed, during the period A of scale removal by the scale breaker 31. However, the internal sensible heat tends to restore the original temperature to raise the surface temperature of the rolled material S, forming scale. During the period X of cooling by the 1st surface cooler 41, the surface temperature of the rolled material S drops to 620° C., restricting the thickness of the scale to 4 $\mu$m. Then, in an attempt to restore the original temperature, the surface temperature of the rolled material S rises based on heat inside the rolled material S. At the time B of finish rolling by the 1st finishing mill 11, however, the surface temperature of the rolled material S drops to 720° C., decreasing the scale thickness to 2 μm. During the period Y of cooling by the 2nd surface cooler 42, the surface temperature of the rolled material S drops to 820° C., restricting the scale thickness to 5 μm. Then, the temperature rises. However, at the time C of finish rolling by the 2nd finishing mill 12, the surface temperature of the rolled material S drops to 730° C., decreasing the scale thickness to 3 μm. Then, during the period Z of cooling by the 3rd surface cooler 43, the surface temperature of the rolledmaterial S drops to 820° C., restricting the scale thickness to 5 μm. Then, the temperature rises, but at the time D of finish rolling by the 3rd finishing mill 13, the surface temperature of the rolled material S drops again, decreasing the scale thickness to 3 μm.

By so repeating cooling and rolling, an artisan of ordinary skill would readily appreciate that the scale thickness of the rolled material S can be finally restricted to 5 μm or less. At the times of rolling by the 4th finishing mill 14 or subsequent finishing mills, the surface temperature of the rolled material S is 900° C. or lower. Thus, no cooling is needed.

FIG. 3 is a graph showing the formation rate of scale versus the surface temperature of the rolled material S. As shown here, the scale formation rate of the rolled material S increases in a curve of the second order with the increase in the surface temperature of the rolled material S. Within the same period of time, one will see that it makes a great difference in the thickness of the resulting scale whether the surface temperature is 1,050° C. or 850° C.

According to the aforementioned embodiment, the 1st, 2nd, 3rd surface coolers 41, 42, 43 are provided on the entrance side of each of the 1st, 2nd, 3rd finishing mills 11, 12, 13, respectively. The number of the surface coolers installed is not restricted to the one indicated in this embodiment. Since the surface temperature of the rolled material S is desirably lowered to 900° or below, there may be surface coolers for the 4th finishing mill 14 and subsequent finishing mills. Furthermore, these may be plural surface coolers positioned between consecutive finishing mills 11–14. Still further, the surface coolers may be positioned before some, or all of the finishing mills 11–14.

As described in detail by the above embodiment, according to the method of the present invention for suppressing the formation of scale defects during hot finish rolling of a strip material using a process that relies on finishing mills provided in a row, an upper surface and a lower surface of the strip material are cooled in a range of 0.3 to 1.5 m toward the upstream side from a position separated by 1.5 m or less from the center of the work rolls of each of the finishing mills toward the entrance side of each of the first predetermined number of finishing mills during the finish rolling of the strip material, to repeat surface cooling and finish rolling of the strip material sequentially until the last of the predetermined number of finishing mills is reached, thereby suppressing the formation of scale defects in the surfaces of the strip material. Since the surface cooling and the finish rolling of the strip material are repeated sequentially, the temperature of the strip material is finally reduced to a predetermined temperature or below. Thus, scale defects which would otherwise form are reliably suppressed, so that the quality of the resulting product can be improved.

According to the system of the present invention for suppressing the formation of scale defects during hot finish rolling, the finishing mill group includes a plurality of sequentially arranged finishing mills for finish rolling a strip material, surface coolers provided for cooling an upper surface and a lower surface of the strip material, the surface coolers being provided on the entrance side of each of the first predetermined number of finishing mills of the finishing mill group, where the range of cooling of the strip material by the surface coolers is set within a range of 0.3 to 1.5 m toward an upstream side from a position separated by 1.5 m or less from the center of the work rolls of each of the finishing mills toward the entrance side of each of the finishing mills. Thus, surface cooling and finish rolling of the strip material are repeated sequentially such that the temperature of the strip material finally becomes a predetermined temperature or below. Thus, scale defects which would otherwise form are reliably suppressed, so that the quality of the resulting product can be improved.

Although the above embodiment includes three finishing mills and associated surface coolers, more or less than three of each can be used. Furthermore, the number of surface coolers may be greater or less than the number of finishing mills.

What is claimed is:

1. A method for suppressing the formation of scale defects during hot finish rolling of a strip material using a plurality of finishing mills provided in a row, comprising:

cooling a surface portion of the strip material at a location upstream of each of a predetermined number of the finishing mills in a transport direction of the strip material, said location being 1.8 to 3.0 m upstream from a center of each of the predetermined number of the finishing mills to suppress the formation of scale defects in surfaces of the strip material and to enable the strip material to be heated to at least 850° C. after hot finish rolling, wherein the cooling is performed prior to and between a series of sequential finish rolling processes until a last of the predetermined number of finishing mills is reached, and wherein the last of the predetermined number of finishing mills is the third finishing mill.

2. The method for suppressing the formation of scale defects according to claim 1, wherein the cooling involves an upper surface and a lower surface of the strip material.

3. A system for suppressing the formation of scale defects during hot finish rolling, comprising:

a finishing mill group composed of a plurality of finishing mills for finish rolling a strip material, said finishing mills being arranged in a row; and surface coolers for cooling a surface side of the strip material, said surface coolers being provided at a location upstream of each of a predetermined number of the finishing mills in a transport direction of the strip material, said location being 1.8 to 3.0 m upstream from a center of each of the predetermined number of the finishing mills to suppress the formation of scale defects in surfaces of the strip material and to enable the finishing mills to heat the strip material to at least 850° C. after hot finish rolling, wherein the cooling is performed prior to and between a series of sequential finish rolling processes until a last of the predetermined number of finishing mills is reached, and wherein the last of the predetermined number of finishing mills is the third finishing mill.

4. The system for suppressing the formation of scale defects according to claim 3, wherein the surface coolers cool an upper surface and a lower surface of the strip material.

5. The system for suppressing the formation of scale defects according to claim 3, wherein the predetermined number of the finishing mills include first, second and third finishing mills, and wherein the surface coolers include first, second, and third surface coolers for cooling an upper surface and a lower surface of the strip material, said first, second, and third surface coolers being positioned at said location relative to the first to third finishing mills, respectively.

6. A system for hot finish rolling a strip material, comprising:

a cooler that reduces a temperature of the strip material to prevent iron oxide growth in excess of 5 $\mu$m on the strip material; and heaters positioned relative to the coolers to enable heating of the strip material to a temperature of at least 850° C. after hot finish rolling, wherein the cooling is performed prior to and between a series of sequential finish rolling processes until a last of the predetermined number of finishing mills is reached, and wherein the last of the predetermined number of finishing mills is the third finishing mill.

* * * * *